US007331802B2

(12) United States Patent
Rothermel et al.

(10) Patent No.: US 7,331,802 B2
(45) Date of Patent: Feb. 19, 2008

(54) ORTHOGONAL CONNECTOR

(75) Inventors: Brent Ryan Rothermel, Harrisburg, PA (US); Chad William Morgan, Mechanicsburg, PA (US); Wayne Samuel Davis, Harrisburg, PA (US); Alex Michael Sharf, Harrisburg, PA (US); David Wayne Helster, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/265,028

(22) Filed: Nov. 2, 2005

(65) Prior Publication Data

US 2007/0099455 A1 May 3, 2007

(51) Int. Cl.
*H01R 13/648* (2006.01)

(52) U.S. Cl. ..... 439/108; 439/608

(58) Field of Classification Search ..... 439/180, 439/608, 109, 544, 701, 61, 65, 101
See application file for complete search history.

(56) References Cited

U.S. PATENT DOCUMENTS 4,703,394 A * 10/1987 Petit et al. ..... 361/790
5,429,521 A 7/1995 Morlion et al.
6,227,882 B1 5/2001 Ortega et al.
6,371,773 B1 * 4/2002 Crofoot et al. ..... 439/79
6,447,340 B1 * 9/2002 Wu ..... 439/660
6,607,401 B1 8/2003 Weaver, Jr. et al.
6,607,402 B2 * 8/2003 Cohen et al. ..... 439/608
6,717,825 B2 4/2004 Volstorf
6,758,695 B2 * 7/2004 Pepe et al. ..... 439/608
6,780,059 B1 8/2004 Payne et al.
7,108,556 B2 * 9/2006 Cohen et al. ..... 439/608
2004/0092140 A1 5/2004 Mashiyama et al.
2005/0148239 A1 * 7/2005 Hull et al. ..... 439/608

FOREIGN PATENT DOCUMENTS

EP 1 049 201 A1 11/2000
EP 1 220 361 A1 7/2002
EP 1 398 852 A1 3/2004

* cited by examiner

*Primary Examiner*—Tho D. Ta
*Assistant Examiner*—Vanessa Girardi

(57) ABSTRACT

An electrical connector includes a housing having a mating face and a mounting face. The housing holds signal contacts and ground contacts arranged in rows. Each of the signal contacts and ground contacts include a mating end extending from the mating face of the housing and a mounting end extending from the mounting face of the housing. For each row, the mating ends of the signal contacts and ground contacts are aligned in a common plane. The mounting ends of the ground contacts are aligned in the common plane, and the mounting ends of the signal contacts are offset from the common plane.

20 Claims, 8 Drawing Sheets

ORTHOGONAL CONNECTOR

BACKGROUND OF THE INVENTION

The invention relates generally to electrical connectors and, more particularly, to a connector that may be used in an orthogonal relationship with an identical connector on both sides of a midplane.

Some electrical systems, such as network switches or a computer server with switching capability, include large backplanes with several switch cards and line cards plugged into the backplane. Generally, the line cards bring data from external sources into the system. The switch cards contain circuitry that may switch data from one line card to another. Traces in the backplane interconnect the line cards and the appropriate switch cards.

Some signal loss is inherent in a trace through printed circuit board material. As the number of card connections increases, more traces are required in the backplane. The increased number of traces and the length of the traces in the backplane introduce more and more signal loss in the backplane, particularly at higher signal speeds. Signal loss problems may be addressed by keeping traces in the backplane as short as possible.

Connectors are sometimes oriented orthogonally on both sides of a midplane in a cross connect application in an effort to minimize the number and lengths of traces in the midplane. Typically, switch cards are connected on one side of the midplane and line cards are connected on the other side. The connectors can have any of several transmission line geometries, and in some cases, a coplanar transmission line geometry is used, wherein signal and grounds are arranged in a spaced apart relationship in a common plane. The line card and switch card connectors are typically mounted on the midplane through vias that extend through the midplane. Connectors oriented orthogonally may allow at least some traces to be eliminated, however, the unused length of the vias, referred to as the via stubs, at the signal connections act as filters which also cause signal loss. Thus, the interconnection of line cards and switch cards through a backplane or midplane with minimal signal loss remains a challenge.

BRIEF DESCRIPTION OF THE INVENTION

In one aspect, an electrical connector is provided. The connector includes a housing having a mating face and a mounting face. The housing holds signal contacts and ground contacts arranged in rows. Each of the signal contacts and ground contacts include a mating end extending from the mating face of the housing and a mounting end extending from the mounting face of the housing. For each row, the mating ends of the signal contacts and ground contacts are aligned in a common plane. The mounting ends of the ground contacts are aligned in the common plane, and the mounting ends of the signal contacts are offset from the common plane.

Optionally, each signal contact includes an offset that moves the mounting end out of alignment with the mating end of the contact. The housing includes a base having signal contact cavities and ground contact cavities. The signal contact cavities include an offset recess proximate the mounting face and configured to receive an offset in the signal contact and a slot transverse to the recess. The signal contact cavities have a T-shaped opening in the mounting face. Each signal contact includes a plate that orients the signal contacts in the signal contact cavities.

In another aspect, an electrical connector assembly including a pair of connectors configured to be electrically connected to one another from opposite sides of a circuit board is provided. The electrical connector assembly includes first and second connector housings, each having a mating face and a mounting face. The mounting faces are configured to be electrically connected to one another from opposite sides of the circuit board in line with one another along a longitudinal axis. Signal and ground contacts are held in the connector housings. Each signal contact and ground contact includes a mating end and a mounting end. Each connector housing includes a common pattern of contact cavities arranged in rows. The signal and ground contacts are held in the contact cavities with the mounting ends extending from the mounting faces of the connector housings. The mounting end of each signal contact in the first connector housing is aligned with a corresponding mounting end of a signal contact in the second connector housing when the first and second connector housings are mounted to opposite sides of the circuit board and are angularly offset at a non-zero angle about the longitudinal axis with respect to one another.

In yet another aspect, an orthogonal connector assembly including a pair of electrical connectors configured to be electrically connected to one another through a circuit board is provided. The orthogonal connector assembly includes first and second connector housings, each having a mating face and a mounting face. The mounting faces are configured to be electrically connected to one another from opposite sides of the circuit board in line with one another along a longitudinal axis. Signal and ground contacts are arranged in rows and held in the connector housings. Each signal and ground contact has a mating end and a mounting end. Each row includes signal contacts and ground contacts arranged in a coplanar geometry at the mating face wherein the signal contacts in each said row are positioned in a plane defined by the ground contacts in the row. Each signal contact includes an offset adjacent the mounting face that moves the mounting ends of the signal contacts out of the plane of the ground contacts. The offset positions the mounting end of each signal contact in the first connector housing in alignment with a mounting end of a signal contact in the second connector housing when the first and second connector housings are mounted to opposite sides of the circuit board and are angularly offset ninety degrees about the longitudinal axis with respect to one another.

DETAILED DESCRIPTION OF THE INVENTION

Figure 1:
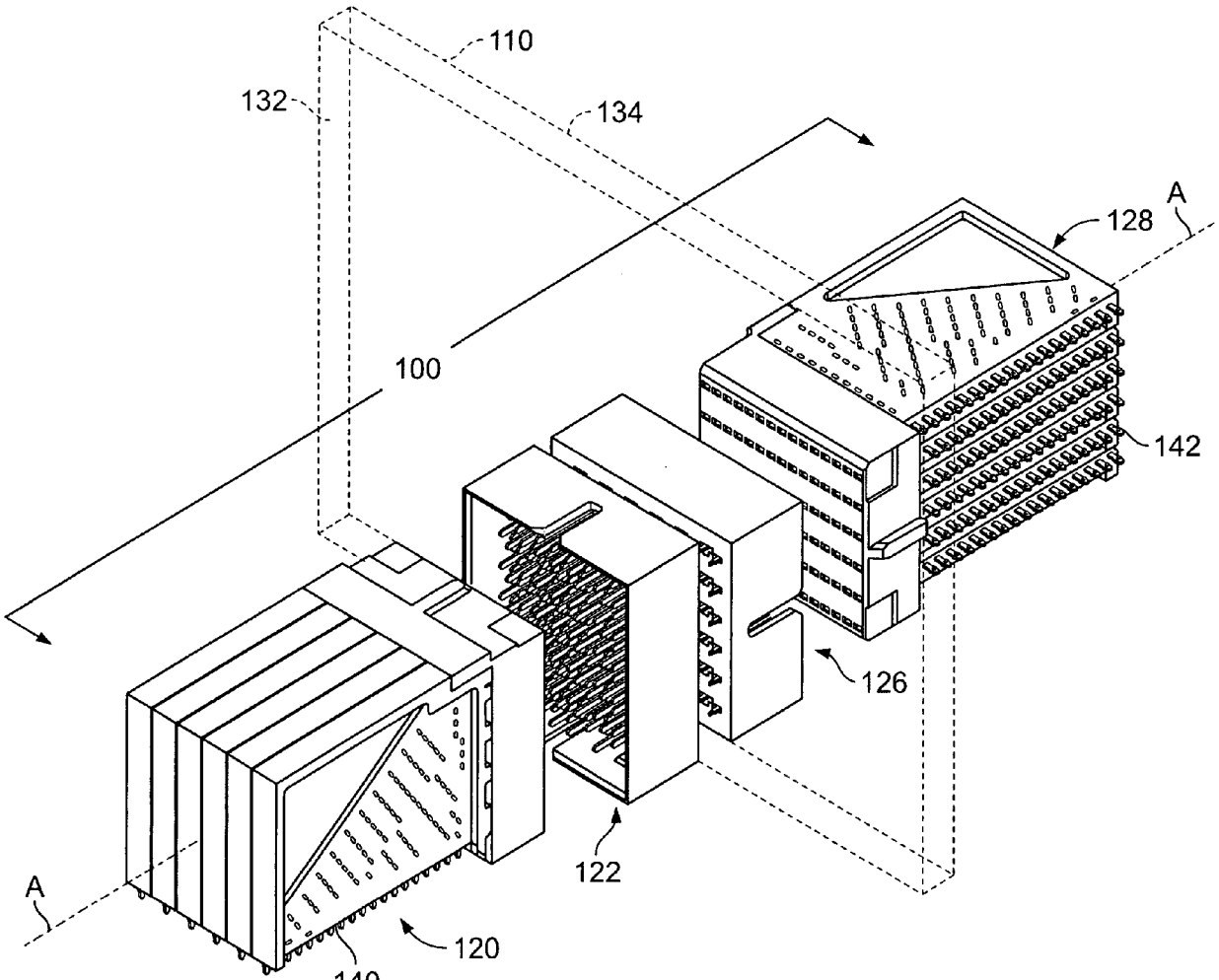
FIG. 1 is a perspective view of an orthogonal connector system formed in accordance with an exemplary embodiment of the present invention.

FIG. 1 is a perspective view of an orthogonal connector system 100 mounted on a midplane circuit board 110 which is shown in phantom lines for clarity. The connector system 100 includes a first receptacle connector 120, a first header connector 122, a second header connector 126, and a second receptacle connector 128. The first header and receptacle connectors 122 and 120, respectively, are mounted on a first side 132 of the midplane 110 and connect through the midplane 110 to the second header and receptacle connectors 126 and 128, respectively, which are mounted on a second side 134 of the midplane 110.

The first receptacle connector 120 includes a daughter card interface 140. By way of example only, the first receptacle 120 may be mounted on a line card (not shown) at the interface 140. Similarly, the second receptacle connector 128 includes a daughter card interface 142 and, by way of example only, the second receptacle 128 may be mounted on a switch card (not shown) at the interface 142. The connector assembly 100 includes a longitudinal axis A that extends from the first receptacle 120 through the second receptacle 128. The first and second receptacles 120 and 128, respectively, are identical to one another. Also, the first and second headers connectors 122 and 126 are identical to one another.

The first and second header connectors 122 and 126 are oriented such that the first and second header connectors 122 and 126 are rotated ninety degrees with respect to one another to form the orthogonal assembly 100. The first and second receptacles 120 and 128 are likewise rotated ninety degrees with respect to one another. The orthogonal orientation of the assembly 100 facilitates the elimination of traces within the midplane and reduces signal loss through the assembly 100, particularly at high speeds, as will be described.

Although the invention will be described in terms of a connector system 100 as illustrated in FIG. 1, it is to be understood the benefits herein described are also applicable to connector systems wherein a receptacle connector is mounted on a midplane circuit board.

Figure 2:
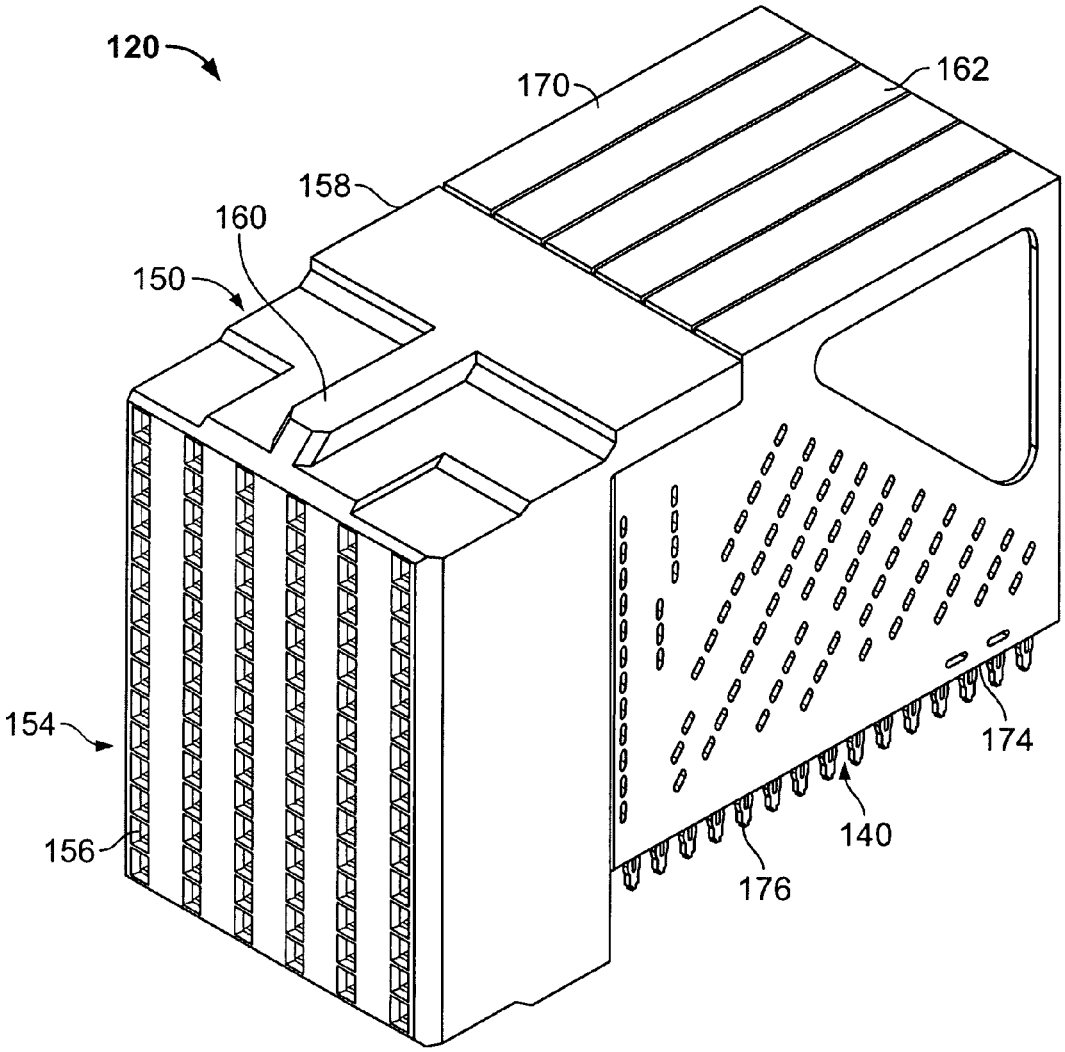
FIG. 2 is a perspective view one of the receptacle connectors shown in FIG. 1.

FIG. 2 is a perspective view of the receptacle connector 120. The receptacle connector 120 includes a dielectric housing 150 that has a mating face 154 having a plurality of contact channels 156. The contact channels 156 are configured to receive mating contacts 226, 228 (see FIG. 4) from a mating header connector such as the header connector 122 shown in FIG. 1. The receptacle connector 120 also includes an upper shroud 158 that extends rearwardly from the mating face 154. Guide ribs 160 are formed on opposite sides of the housing 150 to orient the receptacle connector 120 for mating with the header connector 122. The housing 150 receives a plurality of contact modules 162 holding contacts and conductive paths that connect the daughter card interface 140 with the mating face 154. In an exemplary embodiment, the interface 140 is substantially perpendicular to the mating face 154 such that the receptacle connector 120 interconnects electrical components that are substantially at a right angle to each other.

Each contact module 162 includes a contact lead frame 190 (FIG. 3) that is overmolded and encased in a contact module housing 170 fabricated from a dielectric material. The housing 170 has a forward mating end (not shown) that is received in the receptacle connector housing 150 and a mounting edge 174 configured for mounting to a circuit board. Contact tails 176 extend from the lead frame within the contact module 162 and extend through the mounting edge 174 of the contact module 162 for attachment to a circuit board.

Figure 3:
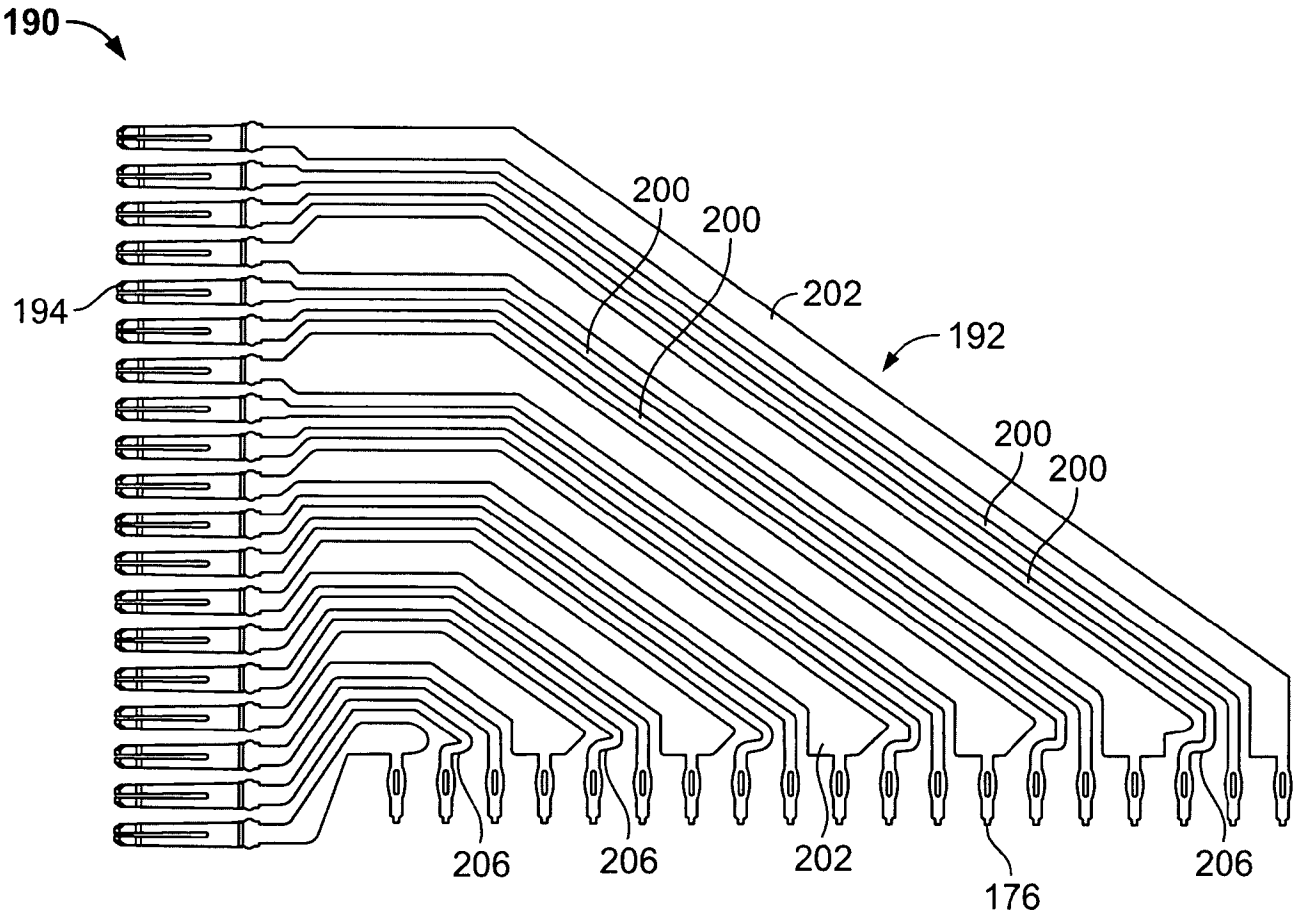
FIG. 3 is a front elevational view of a lead frame formed in accordance with an exemplary embodiment of the present invention.

FIG. 3 illustrates the contact lead frame 190 which may be used in the contact module 162 (FIG. 2). The contact lead frame 190 includes a plurality of conductive leads 192 terminating at one end with a mating contact 194 and terminating at the other end with the mounting contact tails 176. The contact lead frame 190 includes signal leads 200 and ground leads 202 arranged in a pattern. The pattern includes pairs of signal leads 200 and individual ground leads 202 arranged in an alternating sequence. That is, the signal leads 200 are arranged in pairs with one ground lead 202 separating pairs of signal leads 200 from one another. When transmitting differential signals, it is desirable that the lengths of the signal paths for the signal pair be as closely matched as possible so as to minimize skew in the transmitted signal. In the case of the connector system 100 (FIG. 1), the total signal path from the first receptacle connector 120 through the second receptacle connector 128 is without skew, as will be described. The individual lead frames 190 in the contact modules 162 may not be without skew. Further, in an exemplary embodiment, each differential signal pair is designed to include a predetermined amount of skew that is other than zero. The predetermined skew is substantially constant across each differential signal pair within each lead frame 190. Within a differential pair, the shorter of the signal leads 200 is formed with a jog 206 that is configured to provide the predetermined amount of skew.

Figure 4:
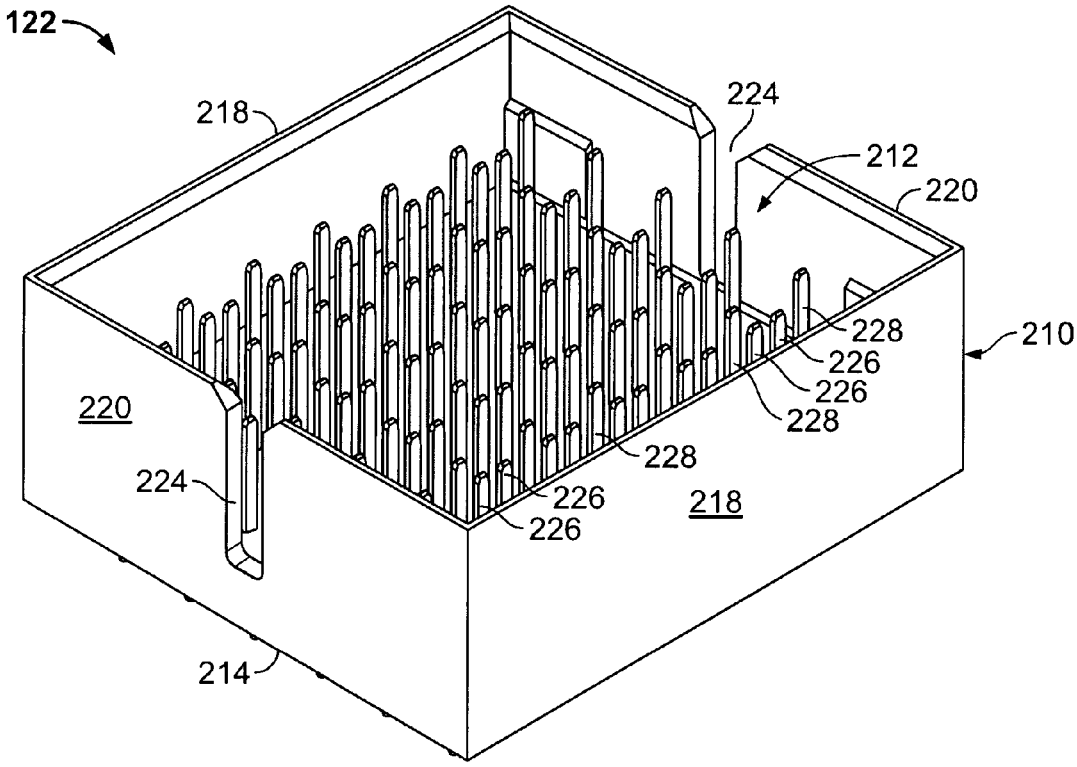
FIG. 4 is a perspective view of a header connector formed in accordance with an exemplary embodiment of the present invention.

FIG. 4 illustrates a perspective view of the header connector 122. The header connector 122 includes a dielectric housing 210 having a mating end 212 that receives the receptacle connector 120 and a mounting end 214 for mounting the header connector 122 to the midplane board 110 (FIG. 1). The housing includes pairs of opposed shrouds 218 and 220 that surrounds the mating end 212. Guide slots 224 are provided on two opposed shrouds 220 that receive the guide ribs 160 on the receptacle connector 120 (FIG. 2) to orient the receptacle connector 120 with respect to the header connector 122. The header connector 122 holds a plurality of electrical contacts, some of which are signal contacts 226 and others of which are ground contacts 228.

The ground contacts 228 are longer than the signal contacts 226 so that the ground contacts 228 are the first to mate and last to break when the header connector 122 is mated and separated, respectively, with the receptacle connector 120 (FIG. 2). The contacts 226 and 228 are arranged in rows including pairs of signal contacts 226 and individual ground contacts 228 arranged in an alternating sequence. In one embodiment, the pairs of signal contacts 226 carry signals in a differential pair. The contacts 226, 228 in each column are arranged in a pattern wherein pairs of signal contacts 226 are separated by individual ground contacts 228. The contact pattern is identical to the contact and lead frame pattern exhibited in the contact modules 162.

Figure 5:
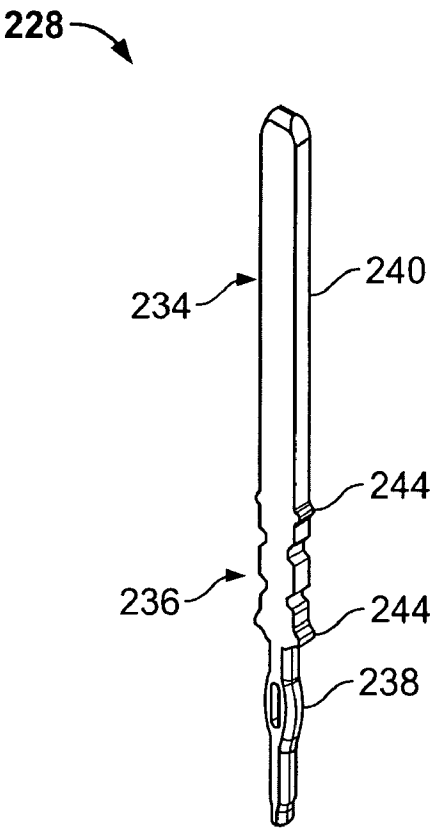
FIG. 5 is a perspective view of an exemplary header connector ground contact.

FIG. 5 illustrates an exemplary ground contact 228 which may be used, for example, in the header connector 122 (shown in FIG. 4). The ground contact 228 includes a mating end 234, a mid-section 236, and a mounting end 238. The mating end 234 comprises a blade section 240 that is configured to be matable with a ground contact in a mating receptacle connector 120 (FIG. 1). The mid-section 236 is configured for press fit installation in the housing 210. The mid-section 236 includes retention barbs 244 that retain the contact 228 in the housing 210. The mounting end 238 extends from the housing 210 and is provided for mounting the header connector 122 to a circuit board, such as the midplane board 110 (FIG. 1) or a panel, or the like. In an exemplary embodiment, the mounting end 238 is a compliant eye of the needle design.

Figure 6:
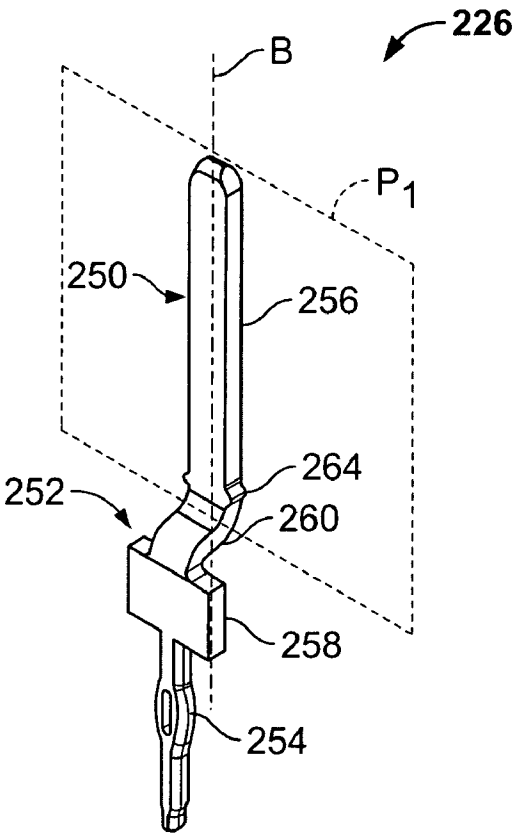
FIG. 6 is a perspective view of an exemplary header connector signal contact.

FIG. 6 illustrates an exemplary signal contact 226 which may be used, for example, in the header connector 122 (shown in FIG. 4). The signal contact 226 includes a mating end 250, a mid-section 252, and a mounting end 254. The mating end 250 includes a blade section 256 that is configured to be matable with a signal contact in a mating receptacle connector 120 (FIG. 1). The mid-section 252 includes a plate 258 and an offset section or jog 260 that interconnects the blade section 256 and the plate 258. A barb 264 at the base of the blade section 256 retains the contact 226 in the header connector housing 210.

The offset 260 shifts the mounting end 254 out of alignment with the mating end 250 of the signal contact 226. More specifically, the blade section 256 has a longitudinal axis B that lies in a plane $P_1$. The offset 260 moves the mounting end 254 out of the plane $P_1$ of the blade section 256. The mounting end 254 extends from the housing 210 and is provided for mounting the header connector 122 to a circuit board, such as the midplane board 110 (FIG. 1) or a panel, or the like. In an exemplary embodiment, the mounting end 254 is a compliant eye of the needle design.

Figure 7:
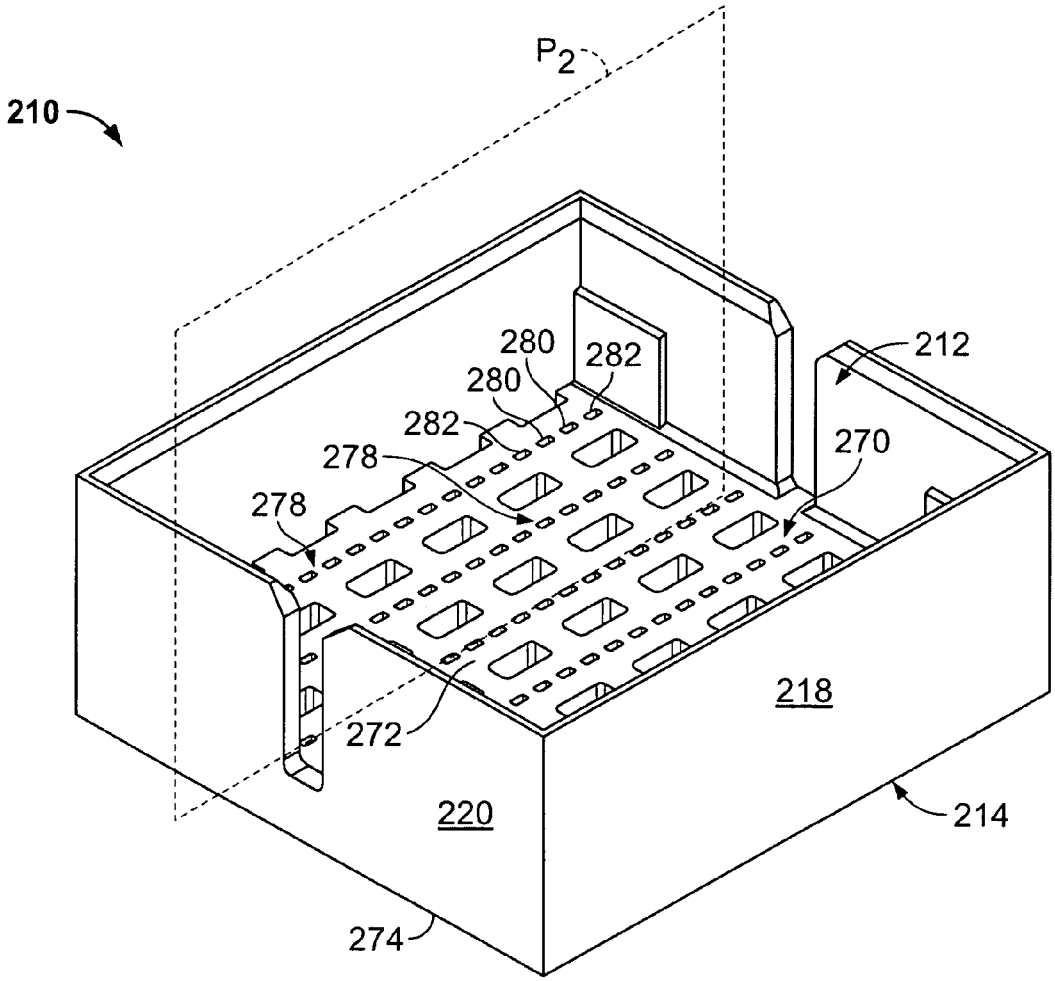
FIG. 7 is a top perspective view of an exemplary header connector housing.

FIG. 7 illustrates a top perspective view of the header connector housing 210. The housing 210 includes a base 270 that has a mating face 272 proximate the mating end 212 and a mounting face 274 proximate the mounting end 214. The mating face 272 includes a plurality of contact cavities disposed in a first arrangement wherein the contact cavities are arranged in a plurality of rows 278. Each row 278 of contact cavities includes signal contact cavities 280 and ground contact cavities 282. In each row, the signal and ground contact cavities 280 and 282, respectively, in the mating face 272, are formed in a common contact plane $P_2$. When the signal and ground contacts 226 and 228, respectively, are loaded in the connector housing 210, the mating ends 250, 234 of the signal and ground contacts 226 and 228, respectively, exhibit the same arrangement as that of the contact cavities on the mating face 272 of the header connector housing. Further, the contact mating ends 234 and 250 of the ground and signal contacts, respectively, in each row, also lie in the plane $P_2$.

Figure 8:
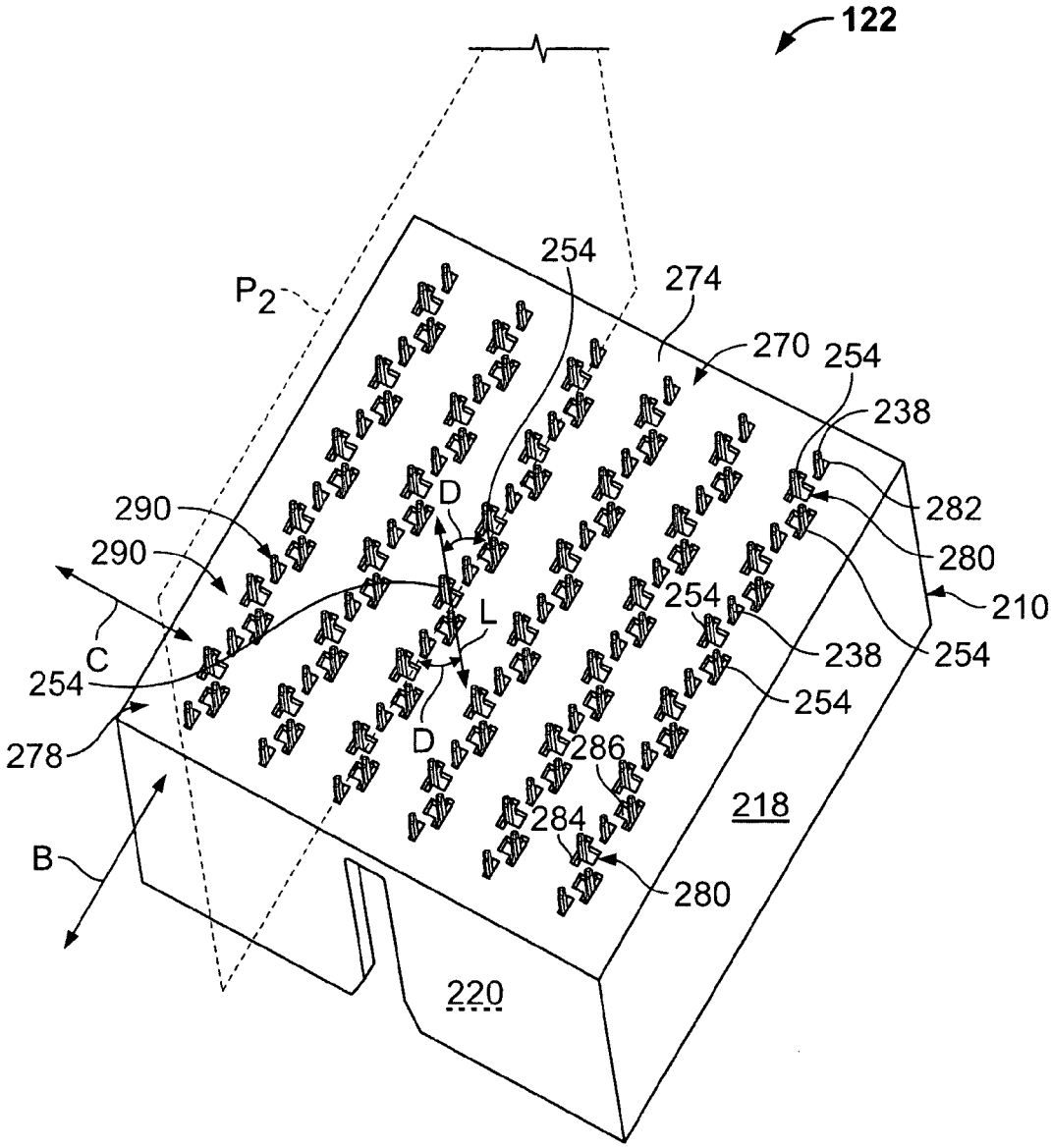
FIG. 8 is a bottom perspective view of an exemplary header connector housing with contacts loaded in the housing.

FIG. 8 illustrates a bottom perspective view of the header connector housing 210 with signal contacts 226 and ground contacts 228 loaded into the housing 210 forming the header connector 122. The contact cavities 280 and 282 extend through the base 270 to the mounting face 274. Signal contact mounting ends 254 extend from signal contact cavities 280. Ground contact mounting ends 238 extend from ground contact cavities 282. At the mounting face 274, the contact mounting ends 254 and 238 are disposed in a second arrangement wherein the contact cavities, 280 and 282, and the contact mounting ends, 238 and 254, are, as on the mating face 272, arranged in a plurality of rows 278 that extend across the mounting face 274 in the direction of the arrow B. Each row 278 includes both signal mounting ends 254 and ground contact mounting ends 238. Further, at the mounting face 274, signal contact mounting ends 254 are offset from the ground contact mounting ends 238 and do not lie in the plane $P_2$ defined by the ground contact cavities 282 and the ground contact mounting ends 238. The signal contact mounting ends 254 of each differential pair define a line L that intersects the plane $P_2$ at an angle D. In an exemplary embodiment, the angle D is forty-five degrees.

The signal and ground contacts 226 and 228, respectively, are loaded into the housing 210 from the mounting face 274. As illustrated in FIG. 8, the signal contact cavities 280 include a slot 284 that receives the plate 258 on the signal contact 226 and a recess 286 in the mounting face 274 that receives the offset 260 of the signal contact 226. The slot 284 is transverse to the recess 286. The slot 284 and recess 286 cooperate to impart a T shape to the signal contact cavities 280 in the mounting face 274. The plate 258 orients the signal contact 226 in the cavity 280. The offset 260 moves the signal contact mounting ends 254 out of the plane $P_2$ of the ground contact mounting ends 238. For each pair of signal contacts 226, the signal contact mounting ends 254 are staggered on respective opposite sides of the plane $P_2$.

As illustrated in FIG. 8, contact columns 290 extend across the mounting face 274 in the direction of the arrow C, perpendicular to the contact rows 278. Each contact column 290 includes only signal contacts 226 or ground contacts 228. When the header connector 122 is rotated ninety degrees about the longitudinal axis A (FIG. 1) with respect to a second identical header connector 122, the contact rows 278 of one header connector 122 are substantially perpendicular to the contact rows 278 of the other header connector 122.

The signal and ground contacts 226 and 228 are configured to be mounted in through vias in the midplane board 110 (FIG. 1) when the header connector 122 is mounted on the midplane board. In addition, the header connector 122 is configured to be mounted in an orthogonal relationship with an identical second header connector 126 on the other side of the midplane board. That is, when the first and second header connectors are angularly offset from each other by ninety degrees about the longitudinal axis A (FIG. 1), the mounting end of each signal contact in the first header connector 122 is positioned to be received in a via that is shared by the mounting end of another signal contact in the second header connector 126. That is, the mounting ends of corresponding signal contacts extend into opposite ends of the same via. In this manner, open ended signal via stubs are eliminated and the need for traces in the midplane board is also eliminated. The elimination of via stubs and traces reduce signal degradation through the connector assembly 100 (FIG. 1). In addition, the direct connection of signal traces between the header connectors provides signal paths between differential pairs that are substantially equal such that skew between differential signal pairs is avoided.

Unlike the signal contacts 226, the ground contacts 228 do not share vias in the midplane board 110 (FIG. 1) when the header connectors 122 are mounted on the midplane. The ground contacts 228 are configured to electrically engage at least one ground plane in the midplane board 110. The ground planes provide continuity between the ground contacts 228 in the header connector 122 from one side of the midplane board 110 to the ground contacts 228 in the header connector 126 (FIG. 1) on other side of the midplane board 110. In alternative embodiments, the header connectors 122 and 126 may be configured such that the ground contacts 228 of the header connector 122 are also received in common through-holes with the ground contacts 228 of the corresponding header connector 126.

Figure 9:
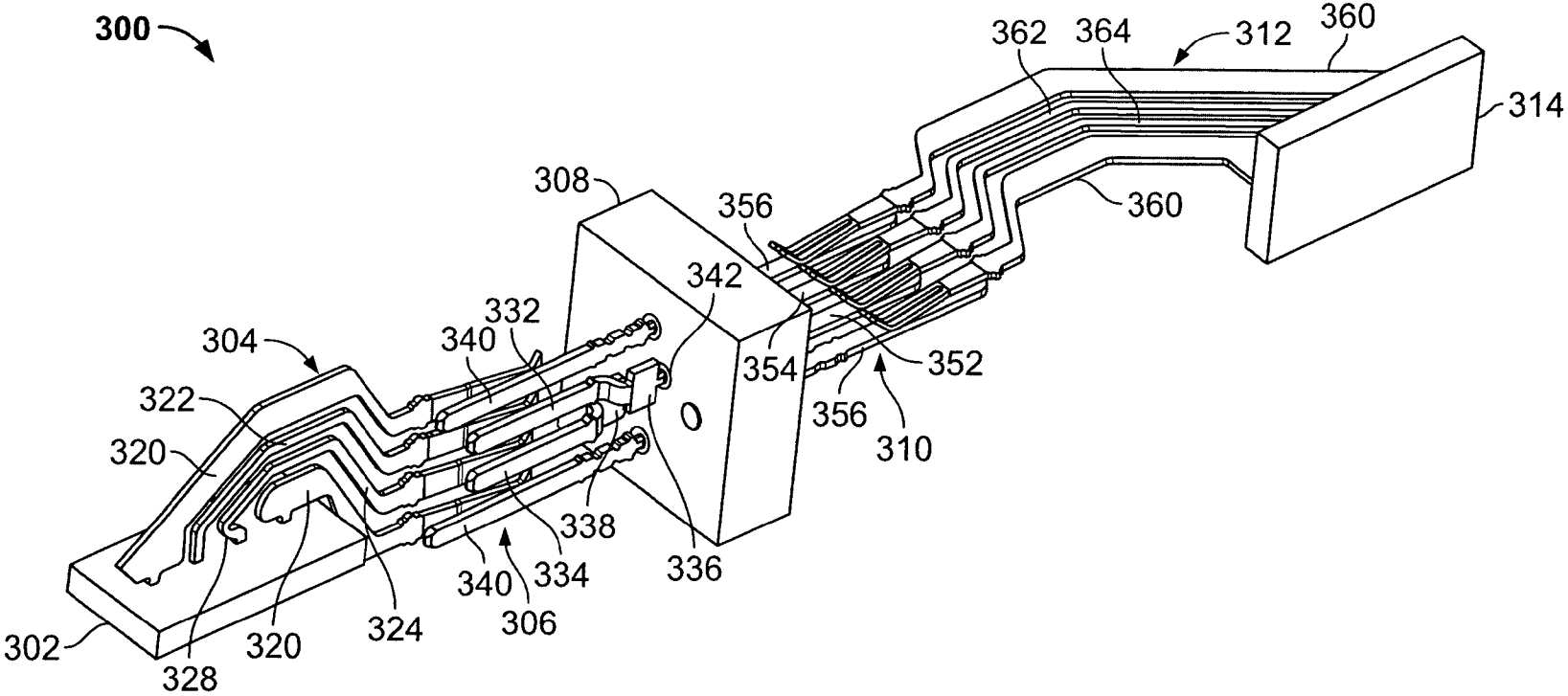
FIG. 9 is a schematic view of an exemplary signal path through a connector assembly.

FIG. 9 is a schematic view of an exemplary signal path through a connector assembly 300 that is representative of the connector system 100 shown in FIG. 1. For clarity, FIG. 9 illustrates the signal path through only one differential signal pair. The assembly 300 includes a first circuit board 302. A first receptacle lead frame 304 is mated to first header contacts 306. The first header contacts 306 are mated through a midplane 308 to second header contacts 310. A second receptacle lead frame 312 is mounted to a second circuit board 314 and is mated to the second header contacts 310.

The first receptacle lead frame 304 includes ground leads 320, a first signal lead 322 and a second signal lead 324. The first signal lead 322 is the longer lead in the differential pair 322, 324. The shorter lead 324 is formed with a jog 328 which is sized to provide a predetermined amount of skew in the differential pair 322, 324. The receptacle lead frame 304 is mated to the header contacts 306. More specifically, the first or longer signal lead 322 is mated with a first header signal contact 332 while the second or shorter signal lead 324 is mated to a second header signal contact 334. The signal contacts 332 and 334 have mounting ends 336 and 338 respectively, that are offset from the first header ground contacts 340. The signal contacts 332 and 334 are electrically connected through signal vias 342, only one of which is visible.

The second header contacts 310 are identical to the first header contacts 306; however, the first and second header contacts 306 and 310, respectively are angularly offset at an angle of ninety degrees with respect to one another. The second header contacts 310 include a third header signal contact 352, a fourth header signal contact 354, and ground contacts 356. At the midplane, the first header signal contact 332 is electrically connected to the third header signal contact 352. In a similar manner, the second header signal contact 334 is electrically connected to the fourth header signal contact 354. The header ground contacts 340 and 356 are indirectly connected by ground planes within the midplane 308.

The second receptacle lead frame 312 is identical to the first receptacle lead frame 304. The second receptacle lead frame 312 includes ground leads 360, a third signal lead 362 and a fourth signal lead 364. The third signal lead 362 is the longer lead in the differential pair 362, 364. The shorter lead 364 is formed with a jog that is not visible in FIG. 9 which is sized to provide the same predetermined amount of skew in the differential pair 362, 364 that is present the signal lead pair 322, 324 in the first receptacle lead frame 304.

The second receptacle lead frame 312 is mated to the header contacts 310. More particularly, the third or longer signal lead 362 is mated with the fourth header signal contact 354 while the second or shorter signal lead 364 is mated to the third header signal contact 352. Thus, the longer third receptacle lead 362 is connected to fourth header contact 354—to second header contact 334—to shorter second lead 324. Similarly, the shorter signal lead 364 in the second receptacle lead frame 312 is connected through to the longer signal lead 322 in the first receptacle lead frame 304. Because the longer receptacle leads 322 and 362 are connected to the shorter receptacle leads 364 and 324, respectively, and because the skew is the same in the receptacle lead frames 304 and 312, the skew from the first receptacle lead frame 304 cancels the skew in the second receptacle lead frame 312 so that the overall skew from the first receptacle lead frame 304 through the second receptacle lead frame 312 is reduced substantially to zero. Consequently the assembly 300 is without skew.

The embodiments thus described provide a connector that may be used with an identical connector in an orthogonal relationship on both sides of a midplane. Signal contacts are electrically connected to signal contacts on the orthogonal connector through vias in the midplane. Moreover, the mounting ends of the signal contacts are received in opposite ends of the same via which minimizes the need for traces within the midplane and reduces losses through the connector. Ground planes in the midplane are used for ground transition between the orthogonal connectors. The use of the same connector reduces connector costs. The connector exhibits reduced insertion loss from daughter card to daughter card with low noise. The connector is also inherently skewless.

While the invention has been described in terms of various specific embodiments, those skilled in the art will recognize that the invention can be practiced with modification within the spirit and scope of the claims.

What is claimed is:

1. An electrical connector assembly including a pair of connectors configured to be electrically connected to one another from opposite sides of a circuit board, said electrical connector assembly comprising:

first and second connector housings, each having a mating face and a mounting face, said mounting faces being configured to be electrically connected to one another from opposite sides of the circuit board in line with one another along a longitudinal axis; and signal and ground contacts held in said connector housings, each said signal contact and ground contact including a mating end and a mounting end, each of said connector housings including a common pattern of contact cavities arranged in rows, said signal and ground contacts being held in said contact cavities such that each row of contact cavities holds both signal and ground contacts with said mounting ends extending from said mounting faces of said connector housings, wherein said signal and ground contacts are disposed in a first arrangement at said mating face, said first arrangement including rows of contacts wherein said mating ends of signal and ground contacts in each said row of contacts are arranged in a common plane, and wherein said mounting ends of said signal and ground contacts are disposed in a second arrangement at said mounting face, said second arrangement including rows of contacts wherein said mounting ends of said signal contacts are out of a plane defined by said mounting ends of said ground contacts, and wherein said mounting end of each said signal contact in said first connector housing is aligned with a corresponding mounting end of a signal contact in said second connector housing when said first and second connector housings are mounted to opposite sides of the circuit board and are angularly offset at a non-zero angle about said longitudinal axis with respect to one another.

2. The connector assembly of claim 1, wherein said mounting end of each said signal contact in said first connector housing and said corresponding mounting end of said signal contact in said second connector housing are received in opposite ends of the same via in the circuit board.

3. The connector assembly of claim 1, wherein said signal and ground contact mating ends each comprise a blade section.

4. The connector assembly of claim 1, wherein at least one of said signal contacts include an offset that moves said mounting end out of alignment with said mating end of said at least one of said signal contacts.

5. The connector assembly of claim 1, wherein said ground contacts are configured to electrically engage a ground plane in the circuit board that provides electrical continuity between ground contacts in said first and second connector housings.

6. The connector assembly of claim 1 further comprising a mating connector joined to each said first and second connector housing, each said mating connector including a contact lead frame having signal leads arranged in differential pairs, and wherein each differential pair within said lead frame has a predetermined amount of skew that is substantially equal.

7. The connector assembly of claim 1 further comprising a mating connector joined to each said first and second connector housing, each said mating connector including a contact lead frame having signal leads arranged in differential pairs, and wherein each differential pair within said lead frame has a predetermined amount of skew that is substantially the same, the predetermined skew being non-zero.

8. The connector assembly of claim 1 further comprising first and second mating connectors joined to a respective one of said first and second connector housings, and wherein said first and second connector housings and said first and second mating connectors define signal paths from said first mating connector through said second mating connector that are substantially skewless when said first and second connector housings are angularly offset ninety degrees about said longitudinal axis with respect to one another.

9. The connector assembly of claim 1, wherein each said connector housing includes a base having signal contact cavities and ground contact cavities and at least one of said signal contact cavities include an offset recess proximate said mounting face configured to receive an offset in said at least one signal contact and a slot transverse to said recess, said at least one of said signal contact cavities having a T-shaped opening in said mounting face.

10. An orthogonal connector assembly including a pair of connectors configured to be electrically connected to one another through a circuit board, said orthogonal connector assembly comprising:

first and second connector housings, each having a mating face and a mounting face, said mounting faces being configured to be joined to one another from opposite sides of the circuit board in line with one another along a longitudinal axis; and signal and ground contacts arranged in rows and held in said connector housings, each said signal and ground contact having a mating end and a mounting end, each said row including signal contacts and ground contacts arranged in a coplanar geometry at said mating face wherein said mating ends of said ground and signal contacts in each said row are positioned in a plane defined by said ground contacts in said row, each said signal contact including an offset adjacent said mounting face that moves said mounting ends of said signal contacts out of said plane of said ground contacts and positions said mounting end of each said signal contact in said first connector housing in alignment with a mounting end of a signal contact in said second connector housing when said first and second connector housings are mounted to opposite sides of the circuit board and are angularly offset ninety degrees about said longitudinal axis with respect to one another.

11. The orthogonal connector assembly of claim 10, wherein said mounting ends of said signal contacts are out of a plane of said mating ends of said signal contacts.

12. The orthogonal connector assembly of claim 10, wherein said mounting end of each said signal contact in said first connector housing and said corresponding mounting end of said signal contact in said second connector housing are received in opposite ends of the same via in the circuit board.

13. The orthogonal connector assembly of claim 10, wherein each said connector housing includes a base having signal contact cavities and ground contact cavities and said signal contact cavities include an offset recess proximate said mounting face configured to receive an offset in said signal contact and a slot transverse to said recess, said signal contact cavities having a T-shaped opening in said mounting face.

14. The orthogonal connector assembly of claim 10 further comprising a mating connector joined to each said first and second connector housing, each said mating connector including a contact lead frame having signal leads arranged in differential pairs, and wherein each differential pair within said lead frame has a predetermined amount of skew that is substantially equal.

15. The orthogonal connector assembly of claim 10 further comprising a mating connector joined to each said first and second connector housing, each said mating connector including a contact lead frame having signal leads arranged in differential pairs, and wherein each differential pair within said lead frame has a predetermined amount of skew that is substantially the same, the predetermined skew being non-zero.

16. The orthogonal connector assembly of claim 10 further comprising first and second mating connectors joined to a respective one of said first and second connector housings, and wherein said first and second connector housings and said first and second mating connectors define signal paths from said first mating connector through said second mating connector that are substantially skewless when said first and second connector connectors are angularly offset ninety degrees about said longitudinal axis with respect to one another.

17. An electrical connector comprising:

a housing having a board mounting face, a board mating face, and signal and ground contacts held in said housing, each said signal contact and ground contact including a mating end and a mounting end, wherein the signal and ground contacts are disposed in a first arrangement at the mating face, the first arrangement including rows of contacts wherein each said row of contacts includes both signal and ground contacts and wherein said mating ends of signal and ground contacts in each said row of contacts are arranged in a common plane, and wherein the mounting ends of the signal and ground contacts are disposed in a second arrangement at the mounting face, the second arrangement including rows of contacts wherein the mounting ends of the signal contacts are out of a plane defined by the mounting ends of the ground contacts, wherein the signal contacts and the ground contacts are receivable in through-holes in a circuit board for electrical connection with a corresponding connector having a corresponding contact pattern, and wherein the contact pattern of the electrical connector is such that the signal contacts of the electrical connector can be received in common through-holes with signal contacts of the corresponding connector when the electrical connector and the corresponding connector are disposed on respective opposite sides of the circuit board and are aligned along a longitudinal axis and are angularly offset by ninety degrees about the longitudinal axis with respect to each other.

18. The electrical connector of claim 17, wherein the contact pattern is identical to the corresponding contact pattern.

19. The electrical connector of claim 17, wherein the electrical connector is identical to the corresponding electrical connector.

20. The electrical connector of claim 17, wherein the ground contacts of the electrical connector can be received in common through-holes with the ground contacts of the corresponding connector.

* * * * *